US011047140B2

(12) United States Patent
Pontecorvo

(10) Patent No.: US 11,047,140 B2
(45) Date of Patent: Jun. 29, 2021

(54) MUD APPLICATOR

(71) Applicant: Gary J. Pontecorvo, Stockton, NJ (US)

(72) Inventor: Gary J. Pontecorvo, Stockton, NJ (US)

( * ) Notice: Subject to any disclaimer, the term of this patent is extended or adjusted under 35 U.S.C. 154(b) by 123 days.

(21) Appl. No.: 16/448,275

(22) Filed: Jun. 21, 2019

(65) Prior Publication Data

US 2019/0390468 A1 Dec. 26, 2019

Related U.S. Application Data

(60) Provisional application No. 62/688,508, filed on Jun. 22, 2018.

(51) Int. Cl.

| | |
|---|---|
| ***E04F 21/08*** | (2006.01) |
| ***B05C 17/00*** | (2006.01) |
| ***B05C 11/10*** | (2006.01) |
| ***B05C 11/11*** | (2006.01) |

(52) U.S. Cl.

CPC ..... *E04F 21/08* (2013.01); *B05C 11/1044* (2013.01); *B05C 11/11* (2013.01); *B05C 17/002* (2013.01)

(58) Field of Classification Search

CPC . E04F 21/08; E04F 21/06; E04F 21/16; E04F 21/02; E04F 21/023; E04F 21/026; B05C 17/002; B05C 11/1044; B05C 11/11; B05C 11/115; B05C 17/00569; B05C 17/00573; B05C 17/0054; B05C 17/015

USPC ..... 401/188 R, 261, 263, 265, 266, 289; 215/272, 273, 278, 284, 291

See application file for complete search history.

(56) References Cited

U.S. PATENT DOCUMENTS

| | | | | |
|---|---|---|---|---|
| 2,678,557 | A * | 5/1954 | Black | E04F 21/08 401/5 |
| 3,532,244 | A * | 10/1970 | Yates, Jr. | B65D 45/322 215/272 |
| 3,880,329 | A | 4/1975 | Gardner, Jr. et al. | |
| 4,848,659 | A * | 7/1989 | Tadych | B05B 9/0416 239/127 |
| 5,156,292 | A * | 10/1992 | Ross | B65D 45/16 215/280 |
| 5,358,000 | A * | 10/1994 | O'Hair | F04F 10/00 137/124 |
| 5,614,021 | A * | 3/1997 | Catlin | B05C 17/035 118/258 |
| 5,863,146 | A | 1/1999 | Denkins et al. | |
| 6,053,365 | A | 4/2000 | O'Mara et al. | |
| 6,382,922 | B1 | 5/2002 | Lewis et al. | |
| 6,484,782 | B1 | 11/2002 | Lewis et al. | |
| 6,712,238 | B1 | 3/2004 | Mills | |
| 8,205,808 | B2 | 6/2012 | Leer et al. | |
| 2006/0120794 | A1 * | 6/2006 | Scott | B05C 17/002 401/188 R |
| 2007/0119876 | A1 | 5/2007 | Roberts et al. | |

* cited by examiner

*Primary Examiner* — David J Walczak
(74) *Attorney, Agent, or Firm* — Gearhart Law LLC; David Postolski, Esq.

(57) ABSTRACT

A mud pumping apparatus that can be removably coupled to a container the mud was originally provided in when first obtained by the user. The mud may be mastic, mortar, grout, joint compound, spackle, or the like. The apparatus may be sized to be used with various standard sized containers, and adjustably powered and controllable to be used with different types, consistencies, and viscosities of spreadable material.

10 Claims, 6 Drawing Sheets

MUD APPLICATOR

CLAIM OF PRIORITY

This application is a United States non-provisional application, and claims priority to U.S. Provisional Application No. 62/688,508, filed Jun. 22, 2018, entitled MUD APPLICATOR, the entirety of which is hereby incorporated by reference as if fully set forth herein.

FIELD OF THE EMBODIMENTS

This invention relates to applicators for applying product like joint compound or mastic, commonly referred to as "mud", and in particular to an applicator apparatus that can be clamped onto an original container of the product for supply.

BACKGROUND

New construction and remodeling projects may require installing materials such as drywall panels, wood paneling, laminate flooring, tiles for floors or walls, and the like. Such projects may require applying a layer of viscous mud-like material during installation. For example, mastic or mortar to adhere paneling or tiles to a wall or floor, or joint compound or spackle to fill spaces between drywall sheets or tiles. In the prior art, this typically included filling a hawk or mud box with the spreadable material, or filling a hopper of a powered appliance that feeds an applicator. However, prior art methods and apparatus can be difficult to master, sloppy to use, difficult to clean up a workspace and equipment after use, too expensive to buy for only occasional use, and the like.

SUMMARY

A mud pumping apparatus that can be removably coupled to a container in which the mud was originally contained when first obtained by the user. The mud may be mastic, mortar, grout, joint compound, spackle, or the like. The apparatus may be sized to be used with various standard sized containers, and adjustably powered and controllable to be used with different types, consistencies, and viscosities of spreadable material.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate disclosed embodiments and/or aspects and, together with the description, serve to explain the principles of the invention. The embodiments described are not intended to be limiting. Instead, the scope of the invention is determined by the claims.

In the drawings.

DETAILED DESCRIPTION

Figure 1:
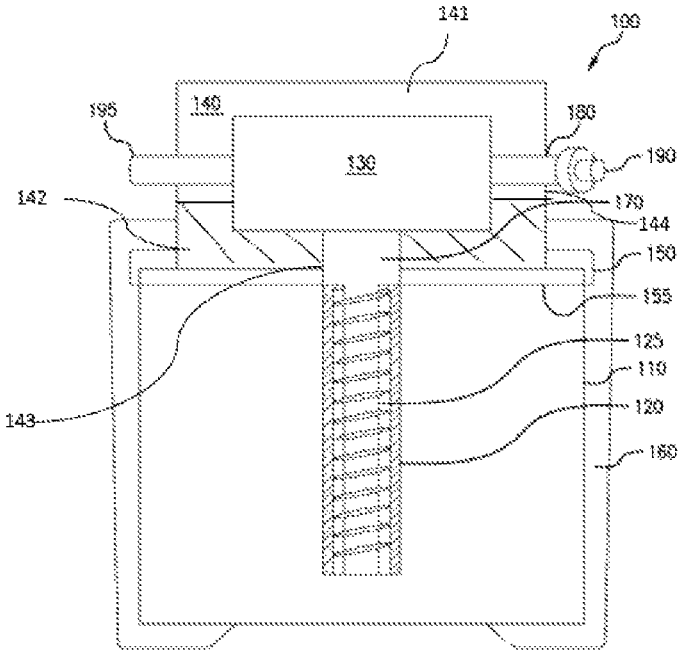
FIG. 1 is a first exemplary embodiment of a mud supply apparatus clamped to a container of mud in accordance with the disclosure.

Aspects of exemplary embodiments of the claimed invention will now be described with reference to the drawings, in which identical elements have the same reference numerals. These embodiments are provided by way of explanation of the present invention, which is not intended to be limited thereto. Those of ordinary skill in the art may appreciate upon reading the present disclosure and viewing the present drawings that various modifications and variations can be made thereto without departing from the scope and spirit of the invention. In addition, it is noted the disclosure pertains to embodiments suitable to accommodate a variety of spreadable materials, to be used in conjunction with various hoses and mud applicator heads. It will be readily understood that the components of the present invention, as generally described and illustrated in the figures herein, may be arranged and designed in a wide variety of different configurations without departing from the scope and spirit of the invention. Thus, the following detailed description of the embodiments and aspects of various apparatus and methods, and the illustrated embodiments and aspects as represented in the attached figures, are not intended to limit the scope of the invention as claimed, but are merely illustrative of selected exemplary embodiments.

FIG. 1 illustrates an embodiment of a mud ingestion system 100 removably coupled to a container 110 in which the mud was originally obtained, from a store for example. Any convenient type of power source may be used to power embodiments of the mud ingestion system, such as an alternating current (AC) outlet, a battery, liquid propane or natural gas, or compressed air. The illustrated apparatus utilizes a pump 130 with an auger type bit inside a mud pipe 120 that is inserted directly into the mud in the container 110. Other types of rotating mud movers may alternatively be used, such as a progressive cavity pump, for example. The mud pipe is configured to have a length extending from the pump inlet to a position near the bottom of the mud container when the apparatus is installed on the container.

In FIG. 1, the mud pipe is an auger tube having a circular cross section. The auger is disposed within the auger tube, coextensive with the second end of the auger tube. The auger has a helical flute inclined to convey mud from its bottom end to the inlet 170. The auger has a diameter that fits snugly within the interior diameter of the auger tube. The auger also has a central shank operatively coupled to a rotating motor shaft of the mud pump.

A central shaft 125 of the auger is connected to an electric motor or fueled engine (collectively, "motor") of the pump 130. The pump 130 is encased in a housing 140 that fits over the top of the open end of the container 110. The housing 140 has a cover portion 141 permanently affixed/attached to a bottom portion 142. The bottom portion 142 of the housing 140 forms an air-tight seal when installed onto a top of an open container of mud. Moreover, the bottom portion 142 of the housing 140 comprises an opening/hole 143 thorough which mud is drawn. The cover portion 141 of the housing 140 comprises a hole/opening 144 through which the drawn mud is pushed. In an embodiment, the bottom portion 142 of the housing 140 contains a replaceable gasket (not shown) or similar compressible impermeable material such as rubber that is pressed on and secured to the top of the container to form an air tight seal. The housing 140 may be secured, for example, with one or more clamps 150 connected to the housing 140, disposed around a circumference of the container to engage a lip 155 or the like around the circumference of the container. Alternatively or in addition, straps 160 may be clamped around the bottom of the container, or clamped to an edge around a bottom circumference of the container. The clamps 150, straps 160, or the like, may be adjustable to provide for the housing 140 to be pressed against the top of the container when the apparatus is installed thereon, to make an air tight seal. The clamps 150 may also be replaceable.

The pump and housing have an inlet 170. As the pump 130 runs, the mud is drawn into the bottom end of the mud pipe and conveyed to inlet 170. The mud passes through the pump 130 and out of the outlet 180, where it is fed into an applicator feed tube (not shown). The outlet 180 is terminated in an outlet coupling device 190 of any appropriate type known in the art. In an embodiment having a flexible feed tube and applicator head components, a first end of the feed tube has a surface configured to match a surface of the container outlet coupling device 190. This matching pair of surfaces can be pushed or screwed together make an air tight seal. Likewise, the applicator head can have a surface configured to match a surface of the other end of the feed tube, to be pressed or screwed onto that end to make another air tight seal.

The matching surface pairs (i.e., an end of the feed tube coupled to the outlet coupling device 190, and the other end of the tube coupled to a connector on the applicator head) are configured with matching surfaces to make their respective air tight seals. There are a variety of matching surfaces that can be used to couple the components together, including ribbed, threaded, and smooth surfaces with a latching element to prevent the surfaces from decoupling. In embodiments, either of the coupling components may be configured as a male end, to be inserted into a matching female end of the other component being joined.

Figure 2:
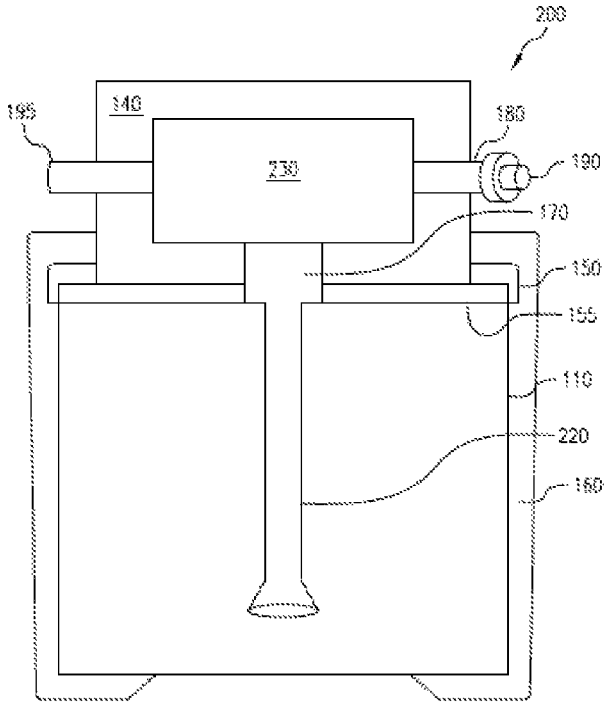
FIG. 2 is a second exemplary embodiment of a mud supply apparatus clamped to a container of mud in accordance with the disclosure.

FIG. 2 illustrates an embodiment of a mud ingestion system 200 that is substantially similar in many ways to that of FIG. 1. The differences have to do with the mechanism by which the mud is conveyed through the system. In particular, the mud pipe can be configured as a siphon 220 that sucks mud from near the bottom of container 110, and conveys the mud through the inlet 170 and the pump 230 and out of outlet 180. The siphon is connected to the pump 230, which is encased in housing 140. In this exemplary embodiment, the pump may be a centrifugal pump, for example. As before, the housing 140 is secured to the top of the container 110 to form a seal around the top of the container, with clamps 150 that connect to the housing, disposed around a circumference of the container, or straps 160 that are clamped to the bottom of the container, or both. The clamps 150 or straps 160, or both, are adjustable to allowing for the housing 140 to be fully sealed against the top of the container 110, making an air tight seal.

As the pump 230 runs, mud is sucked into the inlet 170 and pumped out of the outlet 180, where it is fed into the feed tube (not shown). The outlet 180 is again terminated in a coupling device 190 of any appropriate type known in the art, to which an applicator feed tube is coupled.

Figure 3:
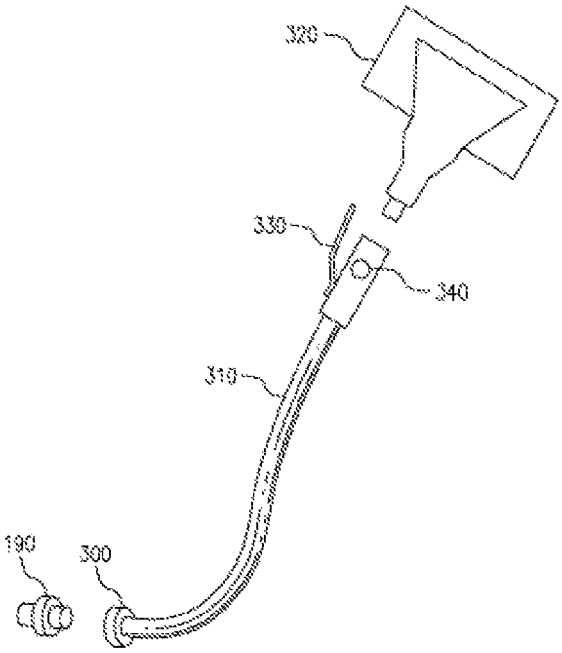
FIG. 3 is an exploded view of an exemplary mud applicator, comprising a feed tube and an applicator head.

As illustrated in FIGS. 1 and 2, in embodiments a mud ingestion system outlet tube 180 may terminate at one end in a coupling device 190 configured to connect to a matching coupling device of an applicator arm to form an air tight seal. Referring now to FIG. 3, coupling device 190 is coupled to matching coupling device 300 of an exemplary applicator feed tube 310. During operation mud is fed from the mud ingestion system outlet into the applicator feed tube 310 coupled thereto, to an applicator head 320, through which the mud is extruded onto a work surface. As noted, in embodiments the feed applicator tube 310, applicator head 320, or both, may be attached to a handle 330 that the user can use to control the placement of the mud onto the work surface.

In embodiments, the pump may be activated and controlled by an on/off control switch 340. The control switch may be placed at any convenient location, such as on or next to the applicator handle 330, or on the feed tube 310, or on the applicator head 320. The pump may be continually or intermittently activated by operating the control switch, which may be combined with the on/off switch 340 as shown, or may be separate from the on/off switch. In embodiments, variable controller 340 may be used to control the speed at which mud is taken up from the container and extruded from the applicator head 320. In embodiments, the control switch may be operatively coupled to the pump using a wireless connection such as a radio frequency (RF) interface, such as a wifi or Bluetooth compliant connection, to send control or other signals to or from the pump. Alternatively, the control switch may be operatively coupled to the pump using a wired connection (not shown), in which the wires may be run along the feed tube 310, for example. In embodiments, two or more feed lines may be supplied by a single mud ingestion system. Preferably, each line may be supplied with its own control switch.

In embodiments, the pump 130 and housing 140 may also comprise an inlet with a threaded end, 195. A water hose may be connected to the inlet 195 so that, as mud is drawn through the pump 130, the viscosity of the mud may be modified by adding a desired amount of water to the mud at the pump. In such an embodiment, the control switch may operate a valve disposed inside or adjacent to the inlet 195 as the pump is controlled. The valve may be activated together with the pump. In embodiments, the control switch may be further configured and arranged to modify the valve opening independently of the pump, to modify the percentage by weight of water in the mud-water mixture as the pump operates, to better adjust the viscosity of the mixture as the mud and water flow through the pump.

Different types of applicator heads 320 can be attached to the feed tube 310, suitable for different types of mud and different applications. The different types of applicator heads may provide a flow rate, extrusion shape, and distribution of mud appropriate for a particular application. For example, an applicator head that extrudes mud to have parallel groves can be used to spread an adhesive compound for use in installing tile, wherein the grooves aid in drying the adhesive and securing the tiles to the work surface. In another example, the applicator head can extrude a smooth, flat layer of joint compound to fill joints and cover tape between dry wall panels to create a uniformly flat wall surface. Other applicator heads may alternatively be used, configured for use in different applications.

Figure 4:
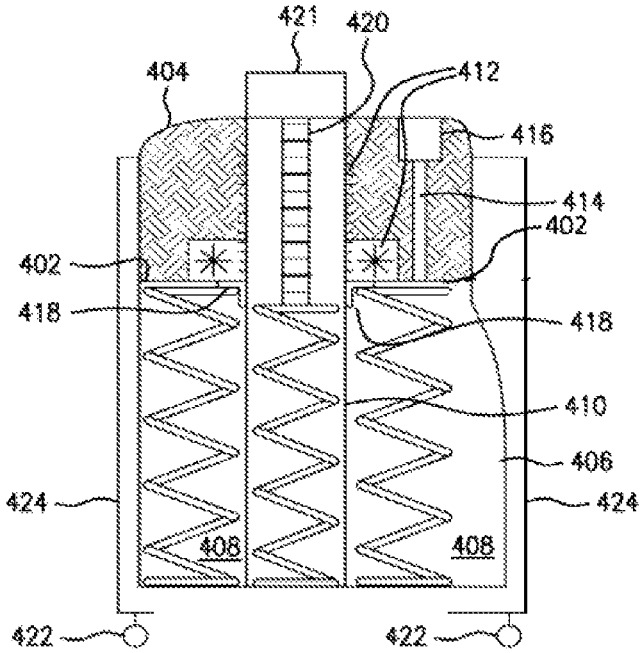
FIG. 4 is an exemplary embodiment of a mud supply apparatus including a piston to provide positive pressure to the mud being pumped, in accordance with the disclosure.

In embodiments, as illustrated in FIG. 4, wheels 422 can be secured to the bottom of the mud container by supporting straps 424. The wheels may be placed under the mud container so the container may be wheeled while the system is being used. In embodiments, a feed line holder (not shown) may be coupled to the feed line that attaches to the operator's belt or waist to carry some of the weight of the loaded feed line. This would be especially useful when applying mud above the level of the operator.

In embodiments, an auxiliary system that works in conjunction with the mud ingestion system previously described may be included that provides a positive flow of mud from within the bucket to the mud pump. One such embodiment is illustrated in FIG. 4, in which a flat piston type system initially has the piston 402 at the top of the motor housing 404 or top of the bucket of mud 406. The piston is pushed downward into the bucket against the mud 408 to push the mud into the mud ingestion system as the mud ingestion system is operated. The piston 402 is shaped to fit snugly within the inside surface of the bucket 406, and has an opening through which the mud pump inlet tube 410 slides, typically along the central axis of a right circular cylindrical shaped bucket. In an embodiment, a flange 418 can be included between the piston opening and the outer casing of the mud pump inlet tube 410 that slides against the outer casing of the pump inlet tube to prevent mud from leaking around the tube as the piston 402 presses against the mud.

In embodiments, the piston 402 may turn clockwise or counter clockwise as it moves downward into the bucket, or it may not rotate as it moves. In embodiments, the piston may slide directly against the smooth outer casing of the mud pump tube, or may slide along matching inter-meshing grooves 412 in the opening of the piston and the outer casing of the mud pump tube. This may help guide the piston to move straight down to the bottom of the bucket as it is pushed against the mud. The piston may be pushed downward into the bucket in a straight non-screwing motion by extendible or fixed arms 414 extending from a piston motor 416 to the top of the piston 402. These are arranged to push the piston down into the bucket via gearing, hydraulics, or other means known in the art.

In other embodiments, the piston 402 may be configured to be screwed down into the bucket along the inter-meshing grooves 412 in a screw-like configuration, similar to a bolt and nut, the bolt being the outer surface of the mud pump inlet tube 410 and the nut being the piston 402. The piston may be pushed downward into the bucket in a circular screwing motion by extendible or fixed arms 414 extending from a piston motor 416 to the top of the piston 402. These are arranged to push the piston down into the bucket via gearing, hydraulics, or other means known in the art.

Another auxiliary system embodiment that works in conjunction with the mud ingestion system previously described includes a flat piston embodiment with motor(s) and interlocking teeth/gears in the straight down or screwed down motion. The piston can be pushed downward into the bucket in a straight motion by providing the piston with an outer casing and piston shaft having teeth on one or more sides which intermesh with the teeth of one or more motors. When the motor(s) are activated in conjunction with the mud ingestion system, the piston is pushed down into the bucket by the gearing action of the intermeshing teeth in a downward motion.

In embodiments, the piston can be pushed in a downward screwing motion into the bucket by providing the piston outer casing and piston shaft with screw threads that intermesh with screw threads of one or more motors. When the motor(s) are activated in conjunction with the mud applicator, the piston is screwed down into the bucket by the screw gearing action of the intermeshing screw threads.

Alternatively, the mud pump inlet tube 410 may itself be turned by a motor of its own in a clockwise or counter clockwise direction. In such an embodiment, the piston 402 may slide straight down against the mud pump inlet tube 410, similar to a bolt and nut arrangement with the bolt turning and the nut remaining stationary. The piston 402 may be pushed down into the bucket by gearing, hydraulics or other means emanating from a motor system. A second inner casing may encase the mud pump inlet tube 410, allowing the auger bit 420 to be in a tube during the activation of the mud applicator. In an embodiment, the outer casing/piston shaft can be fixed in place and the flat piston can be screwed down into the bucket by gearing, hydraulics or other means emanating from the motor system. In another embodiment, the auger bit can be screwed down to the bottom of the bucket at the time the mud ingestion system is installed on the mud bucket. As the mud ingestion system is operated, the auger bit 420 is simultaneously turned and pulled in an upward motion by auger bit motor 421. The upward motion of the auger bit 420 causes mud to be pushed up against the bottom of the motor housing (at the top of the bucket) and fed at a constant rate into the pump inlet as the auger bit rotates.

Figure 5:
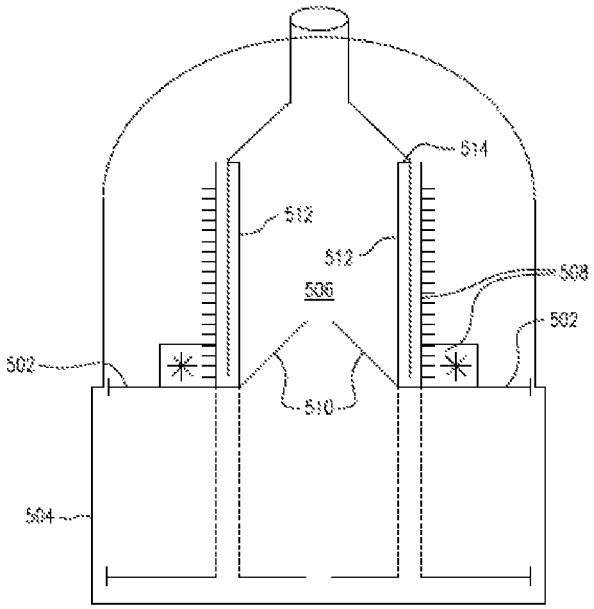
FIG. 5 is another exemplary embodiment of a mud supply apparatus including a piston to provide positive pressure to the mud being pumped, in accordance with the disclosure.

Another auxiliary system embodiment that works in conjunction with a mud ingestion system is illustrated in FIG. 5. Similarly to the auxiliary system embodiment illustrated in FIG. 4, a piston 502 pushes mud from its original container 504 to a feed chamber 506, with inter-meshing grooves 508 or the like guiding the piston 502 downward. However, in this embodiment, piston 502 is coupled to piston feed chamber sleeves (PFCS) 512 that are initially disposed against the walls of the feed chamber 506. As the piston 502 pushes the mud in the mud container 504 down, the PFCS 512 also descend into the mud container, extending downward to the bottom of container 504.

The PFCS 512 may have feed chamber closing flaps 510 coupled to the bottom of each side of the PFCS. The feed chamber closing flaps 510 may move from horizontal (perpendicular to each PFCS) to vertical when they lay flat against the PFCS. The chamber closing flaps 510 lay vertically against the PFCS when the piston 502 is pushed down into the container 504 and the mud is pushed up into the feed chamber 506. Conversely, after the piston reaches the bottom of the mud container and mud resides only in the feed chamber, the piston may be pulled up in the container 504. This causes the chamber closing flaps 510 to close, sealing the bottom end of the feed chamber 506, and causing the mud still contained in the feed chamber 506 to be pushed toward the top of the feed chamber and out of the mud outlet 180.

In embodiments, the chamber closing flaps 510 can be replaced with a feed chamber sealing plate pushed into place by a motor and interlocking teeth (not shown), that operate on the top side of the piston.

Figure 6:
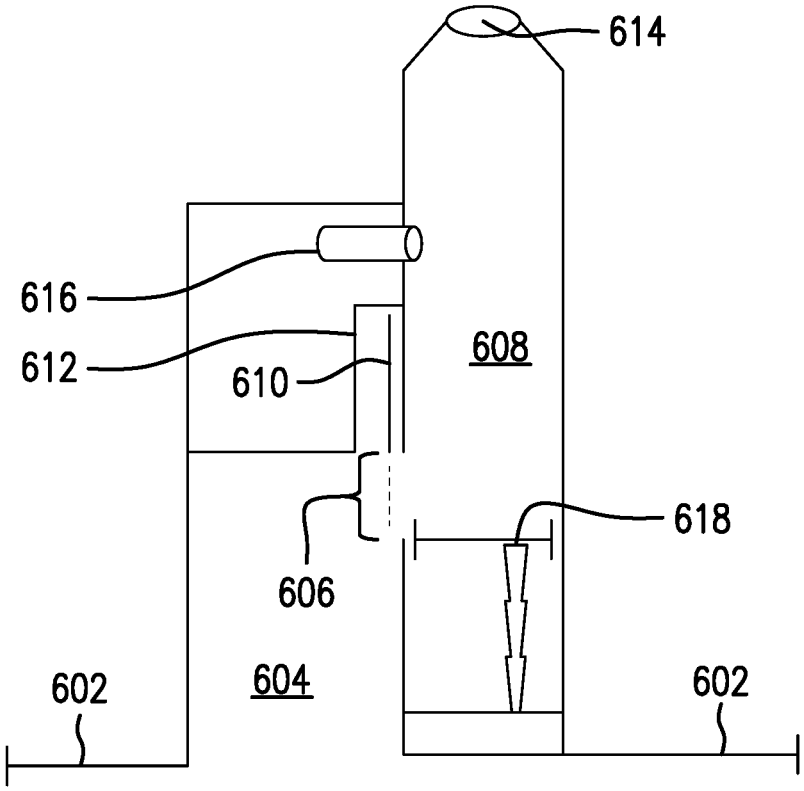
FIG. 6 is yet another exemplary embodiment of a mud supply apparatus including a piston to provide positive pressure to the mud being pumped, in accordance with the disclosure.

FIG. 6 illustrates another embodiment, activated by a trigger at the end of the feed line (not shown). This embodiment has a first pump chamber 604 having an opening 606 to a second pump chamber 608. A chamber separator 610 is disposed therebetween, slidable between an open position in which the chamber separator 610 resides in housing 612 and leaves the opening 606 uncovered, and a closed position (represented by a dotted line adjacent to opening 606) that covers and closes opening 606. When the system is activated, the chamber separator 610 remains in its open position as piston 602 is pushed down into the mud container, pushing mud into the first pump chamber 604, through the opening 606 and into the second pump chamber 608 to a feed tube opening 614. When the mud reaches the feed tube opening 614, pressure builds up in the second pump chamber 608. A pressure sensor 616 detects the elevated pressure, and sends a signal to a driver of chamber separator 610 (not shown), causing the chamber separator 610 to slide to its closed position.

Thereafter, at each trigger pull the pump piston 618 is activated and pushes the mud in the second pump chamber through the feed tube opening 614 and into the feed line to the mud applicator. When the pump piston 618 reaches the top of the second pump chamber 608 a contact/sensor (not shown) will activate, causing a pump piston driver (not shown) to return the pump piston 618 to the bottom of the second pump chamber 608, and at the same time causing the chamber separator 610 to return to its open position within its housing. Until these operations are completed, the trigger may also be deactivated, and mud will stop being dispensed.

Thereafter, the piston motor independently or upon activation of the trigger will reactivate the piston 602, pushing it further down into the mud container to push more mud into the first pump chamber 604, and continuing the cycle just described. When the piston 602 reaches the bottom of the mud container, mud still resides in the first and second feed chambers. The bottom of the first feed chamber 606 may then be sealed to retain the mud in the feed chambers 604, 608 as the piston 602 is lifted by its motor back up to the top of the mud container. The first feed chamber 604 can be sealed in any convenient manner. For example, feed chamber closing flaps (not shown in FIG. 6) may be attached to the bottom of the walls of the first feed chamber. The closing flaps may be pushed flat against the chamber walls as mud is pumped into the chamber, and pulled down again as piston 602 is raised, as described in connection with FIG. 5. Alternatively, a feed chamber closing plate (not shown) may be activated to seal the feed chamber opening.

In embodiments, the feed lines and the mud applicators may be provided with one or more air release valves (not shown), to allow air being pushed through the feed line to escape during priming of the feed line, filling the mud applicator with mud only.

The disclosed embodiments can be used to supply tile grout, mortar, mastic, joint compound, or other premixed material of similar consistency and flow properties, directly from the original container. The flowing materials may be obtained pre-mixed in their container, or may be mixed in their container, and applied using the apparatus.

After use, if the entire contents of the container have not been applied and will be used again within a reasonably brief amount of time, such as within a day or two, or perhaps more depending on the flowing material being used. The air tight seal between the apparatus and the container will maintain the proper consistency of the material as effectively as if the apparatus was removed from the container, and the lid of the container replaced. The material inside the feed tube may also be maintained in a similar condition by removing the applicator head and sealing the end of the feed tube. The applicator head should generally be washed between uses. This practice may give acceptable results for brief periods of time between uses. However, for a somewhat longer period of time between uses, such as several days, the feed tube should also be removed from the outlet coupling device 190 and outlet 180 sealed at the coupling end. This will store the material within the original storage bucket and the motor housing. The feed tube may then also be cleaned.

In embodiments, at the end of use until the next day or longer thereafter, the applicator may be disconnected from the feed line and washed clean with water or other solvent if appropriate, depending on the type of mud material that was extruded. Mud remaining in the feed line can be pushed back into the feed chamber by inserting a feed line cleaning rod (not shown) into the feed line. The feed line cleaning rod fits snugly inside the feed line, with just enough spacing to allow it to be pushed into the feed line. The feed line cleaning rod may be pushed into the feed line until it reaches the end of the feed line where it is coupled to the motor housing. This pushes the mud remaining in the feed line back into the feed chamber.

When finished using the disclosed apparatus, water or other appropriate cleaning agent may be run through the entire apparatus, feed tube, and applicator head for cleaning. Moreover, embodiments having one or more piston feed chamber sleeves can include chamber scrapers on the top of the chamber sleeves, to scrape and prevent mud from clogging space between the flat piston feed chamber sleeves and the feed chamber walls. In an embodiment, the end of the mud tube may advantageously be configured to be coupled to a threaded hose connector. A water hose can then easily provide water to flush through the apparatus, feed tube, and applicator head in a single operation. Alternatively or in addition, a water hose can be coupled to the housing inlet 195 to clean the apparatus.

It is noted that prior art mud appliances generally require the mud to be removed from its original container and placed into a holding tank of the appliances. Other prior art approaches may require manual solutions such as placing mud in a mud box or on a hawk and, using a trowel with a handle or pole affixed to it, spread the mud by drawing the trowel across the work surface, such as a wallboard, floor board, or like surface.

Advantages of the disclosed apparatus include that the mud (spackle, joint compound, adhesive, etc.) is not removed from its original container prior to use, unlike prior art practices. Moreover, the mud can be stored for reasonably short periods in its original container with the apparatus installed, such as to continue a job in progress the next day. Further, the disclosed apparatus does not rely on gravity as a mud mover. Instead, it is fed using a powered auger tube or suction pipe. The apparatus can be manufactured in various sizes to accommodate various standard size containers, commonly 1 lb., 2 lb., 3.5 lb., 4 lb., or 5-lb. containers, although other sizes may also be accommodated. The container contents may be measured by volume or by weight, using metric, imperial, or other measuring bases. In embodiments, the disclosed apparatus can be transported in one piece, with or without being installed on a mud container.

In the foregoing, when introducing disclosed embodiment(s) or aspects thereof, the articles "a," "an," and "the" are intended to mean that there are one or more of the elements or aspects. Similarly, the adjective "another," when used to introduce an element, is intended to mean one or more elements. The terms "including" and "having" are intended to be inclusive such that there may be additional elements other than the listed elements.

Although the embodiments have been described with a certain degree of particularity, it is to be understood that the foregoing disclosure has been made only by way of illustration and not limitation. Numerous changes in the details of construction and arrangement of parts may be made without departing from the spirit and the scope of the invention as defined by the appended claims.

What is claimed is:

1. A mud pumping apparatus comprising:

a mud pump having an inlet port and an outlet port and capable of pumping grout from the inlet port to the outlet port;

a housing enclosing the mud pump, wherein the housing comprises a cover portion permanently attached to a bottom portion, wherein the bottom portion is configured to form an air-tight seal when installed onto a top of an open container of mud, wherein the bottom portion of the housing comprises a hole through which mud is drawn, and wherein the cover portion of the housing comprises a hole through which the drawn mud is pushed;

a mud pipe having two open ends including a first end attached to the pump inlet port and a second end to be inserted into the open container of the mud, wherein the mud pipe has a length extending from the pump inlet port to a position near a bottom of open container of the mud when the mud pumping apparatus is installed on the open container of the mud to draw mud from the open container of the mud to the pump inlet port, wherein the mud pipe is a circular auger tube further comprising an auger disposed within the circular auger tube coextensive with the second end, wherein the auger comprises a helical flute and a diameter that fits snugly within a diameter of the circular auger tube and a central shank operatively coupled to a rotating motor shaft of the mud pump, and wherein the auger is configured to draw mud from the open container of the mud into the auger tube;

an outlet port coupler that couples the outlet port to a mud applicator that conveys the mud to a work surface; and a container coupler that couples the housing to the open container of the mud to form an air-tight seal between the bottom portion of the housing and the top of the open container of the mud.

2. The apparatus of claim 1, wherein the container coupler comprises a clamp configured to engage a lip around an external circumference of the open container of the mud and to tighten against the lip to form an air-tight seal between the bottom portion of the housing and the open top of the container of the mud.

3. The apparatus of claim 1, wherein the container coupler comprises a strap that is clamped to engage an edge around a bottom circumference of the open container of the mud and to tighten against the edge to form an air-tight seal between the bottom portion of the housing and the open top of the container of the mud.

4. The apparatus of claim 1, further comprising an applicator removably coupled to the outlet port coupler to convey the mud to a work surface.

5. The apparatus of claim 4, the applicator comprising an applicator head configured to extrude the mud onto the work surface to have a desired extruded cross sectional shape and size.

6. The apparatus of claim 4, further comprising an applicator handle attached to the applicator for a user to grasp and direct extrusion of the mud onto the work surface.

7. The apparatus of claim 1, further comprising a switch to start and stop a drawing of mud from the open container of the mud to the pump inlet port.

8. The apparatus of claim 1, further comprising a variable switch to variably control a volume of the mud drawn from the open container of the mud to the pump inlet port.

9. The apparatus of claim 1, wherein the pump inlet port is threaded for coupling to a water hose for flushing water through the mud pumping apparatus.

10. The apparatus of claim 1, wherein the housing further comprises an inlet with a threaded end to push water into the mud pump to adjust a viscosity of the mud during use, and for cleaning the mud pump.

* * * * *